US012392121B1

(12) United States Patent
Hunt

(10) Patent No.: US 12,392,121 B1
(45) Date of Patent: Aug. 19, 2025

(54) KITCHEN SINK CORRALLING AND TRANSFER APPARATUS TOOL

(71) Applicant: James Michael Hunt, Winchester, MA (US)

(72) Inventor: James Michael Hunt, Winchester, MA (US)

( * ) Notice: Subject to any disclaimer, the term of this patent is extended or adjusted under 35 U.S.C. 154(b) by 106 days.

(21) Appl. No.: 18/376,399

(22) Filed: Oct. 3, 2023

Related U.S. Application Data

(63) Continuation-in-part of application No. 17/702,678, filed on Mar. 23, 2022, now abandoned.

(51) Int. Cl.
*E03C 1/264* (2006.01)

(52) U.S. Cl.
CPC ..... *E03C 1/264* (2013.01)

(58) Field of Classification Search
CPC ... E03C 1/26; E03C 1/264; A47K 1/14; A47L 17/06; A47L 25/00; B25B 13/48
USPC ..... 4/292, 295; 15/105; D7/375; D8/14; D32/14
See application file for complete search history.

(56) References Cited

U.S. PATENT DOCUMENTS

| | | | | |
|---|---|---|---|---|
| 4,268,080 | A * | 5/1981 | Lindley | B65F 1/1405 294/219 |
| D372,650 | S * | 8/1996 | Bundy | D8/14 |
| 2006/0107476 | A1* | 5/2006 | Mameletzi | A47L 17/04 15/105 |
| 2009/0094766 | A1* | 4/2009 | Dombrowski | E03C 1/126 15/105 |
| 2012/0124724 | A1* | 5/2012 | LaPointe | E03C 1/186 4/295 |

* cited by examiner

*Primary Examiner* — Christine J Skubinna

(57) ABSTRACT

A debris corralling tool for use in a sink is disclosed and comprises a removable hand hold component; a circular flat component having a side edge having a vertical face, wherein the circular flat component is attached to and below the handhold component, wherein the circular flat component and vertical face have a slot formed therein; and an extension component, the extension component having a vertical portion attached to and extending downward from the circular flat component and terminating at attached disk component, wherein the disk component has a bottom surface, the bottom surface having a plurality of contact points configured to trap debris between individual contact points in the plurality.

12 Claims, 4 Drawing Sheets

13
17
44
56
08
104
10

44
10

17
13
44

13
17
08
44
53
58
60
104
48
73
10

KITCHEN SINK CORRALLING AND TRANSFER APPARATUS TOOL

REFERENCE TO RELATED APPLICATION

This is a continuation-in-part of U.S. patent application Ser. No. 17/702,678 filed Mar. 23, 2022, which is co-pending.

FIELD OF THE INVENTION

The present invention relates to a food debris transfer apparatus and refers more particularly to an apparatus to facilitate the corralling and transferring of food solids and liquids, in the in-sink physical space above the sink floor, where a garbage disposal is attached to the underside of the kitchen sink floor.

BACKGROUND OF THE INVENTION

In the operation of washing dishes in a sink, moreover a kitchen sink, where food debris and dish ware are both present and said debris must be discarded; access to the garbage disposal becomes encumbered. Dishes cover the sink drain hole and access is blocked. In such a situation, an in sink corralling and transfer apparatus may be used and stubborn debris may need persuasion to be manually pushed through the apparatus and a tool for such a task is needed. The need for this invention arose out of development of a need of my currently pending invention that uses the in-sink space to corral and transfer kitchen sink debris into the garbage disposal through the sink collar. The following discussion describes the problems encountered with existing prior art.

U.S. Pat. No. 5,473,728 discloses an improvised garbage disposal cap for scraping waste from eating wear and sinks that allow safe insertion of waste into the disposal unit. The garbage disposal cap is equipped with circular shape which may be constructed of sponge or other materials. Waste is scraped from eating wear and pushed into the disposal unit. The disposal cap further acts as a drain cap by pushing the plunger portion through the disposal and the cap portion sealing over the top of the splash guard. The invention further acts as a disposal guard by resting the scraper-plunger portion on the splash guard with the cap of the invention at sink level allowing for normal use of the sink and water flow.

SUMMARY OF THE INVENTION

The present invention provides a tool for facilitating the transfer of food debris solids and liquids that are corralled within a kitchen sink corralling and transfer apparatus, but not limited to such apparatus, to be manually pushed through said apparatus by using the invented tool, physically located predominantly in the in-sink space. Additionally, the tool when sealed to the kitchen sink corralling and transfer apparatus eliminates ejected sink material from the confines of said apparatus and attenuates garbage disposal noise being resonated through said apparatus. This sealing task is completed by installing a sink debris corralling and transfer apparatus tool and rotating the slots of said tool to align with the apparatus finger lift(s) to create a sealing relationship with the sink debris corralling and transfer apparatus debris feed orifice perimeter. The tool includes a removable hand hold component, a circular flat surface component, a side edge component (that has at least one slot components located in a manner that allows the acceptance of the finger lift components of a kitchen sink debris corralling and transfer apparatus) attached to the circular flat surface component, and an extension component that may permanently attach proximal and distal end components or have the capacity to be removable through a connection such as having an integrated female screw acceptors attached to said terminal ends of said circular flat component/hand hold union and an extension union that internally houses a permanent female screw housing and at the other terminal end, a smaller circular disk, that houses a screw used at the distal end of said extension that has raised surfaces on the bottom plane of the disk such as a patterned pyramid points or wave type of design to assist in grabbing long or wet hard to push debris.

A still further aspect of the invention is to provide the tool extension element, of length, to provide effective transfer of refuse through the entire length of the kitchen sink corralling and transfer apparatus's conical frustum area for corralling and transferring large sized food debris solids, chunky yogurt liquids or the like within the in-sink space. In a still further aspect of the invention, the tool, when installed in its useful position inside a kitchen sink corralling and transfer apparatus, will not interfere with the flow of water from the outside of the apparatus through to the garbage disposal.

A further aspect of the invention is to provide the tool an effective total vertical height that is useful for its intended purpose in the in-sink physical space when used in conjunction with a kitchen sink corralling and transfer apparatus where the effective height of said apparatus creates a physical barrier by having an effective vertical structural height; thereby overcoming the height of multiple levels of dish ware to be held back from the sink drain hole. Additionally, not short enough to enable cups and glassware to tip over when jammed together in a sink causing breakage as a garbage disposal guard would do.

Another aspect of the invention is to provide a tool which does not hinder water, seeds and the like to be transferred into the sink drain hole through the kitchen sink corralling and transfer apparatus's tear drop weep holes.

A further aspect of the invention is to provide an element which prevents splashing back of liquids and solids from the sink, and also splashing back of liquids into the sink. This is accomplished by providing a top, preferably circular flat component, seated atop of the kitchen sink corralling and transfer apparatus' in-sink orifice in its useful position.

An additional aspect of the invention is to provide the ability of the apparatus flaps that cover over the tear drop weep holes of the kitchen sink corralling and transfer apparatus to function properly. The apparatus flaps diverts the liquids being poured into the apparatus from the in-sink orifice effectively shielding the tear drop weep holes from all liquids and solid debris being corralled and transferred through said apparatus.

Another aspect of the invention is to provide a tool which enables easy locking to the kitchen sink corralling and transfer apparatus for removal from and insertion into the in-sink space of the kitchen sink and to minimize resonating garbage disposal noise when powered on. The tool provides a semi-open horizontal notch that, when the tool is turned by its hand hold in its useful position, will enable a proper slotting for the finger lift(s) on the kitchen sink corralling and transfer apparatus thus creating a sealing nature.

Yet another aspect of the present tool is, when installed in its useful position, does not interfere with the flow of water from the outside of the apparatus through to the garbage disposal. This may be accomplished by having a smaller circular disk component size in relation to the most restrictive part of the apparatus. More specifically, a disk size smaller than the internal diameter of the kitchen sink corralling and transfer apparatus flap components.

Another aspect of the invention is to provide a locking mechanism. When locked to the kitchen sink corralling and transfer apparatus said tool creates a locked connection reducing an accidental blow off from occurring due to direct upward ejection forces from large fruit pits, large items like fish or bananas when the garbage disposal is powered on and active.

Lastly, another aspect of the invention is to provide a preferably smaller disk embodiment, used at the distal portion of the earlier mentioned extension element in a vertical arrangement. Which has on the bottom surface of said disk a series or patterns of wave-like or pyramidal points, for example. These elevated grooves or points that extend from the bottom portion of the disk encourage secure holding of particularly tough food debris that becomes unwieldy to push through a kitchen sink corralling and transfer apparatus.

DETAILED DESCRIPTION OF THE PRESENT INVENTION

Figures 1, 2, 3:
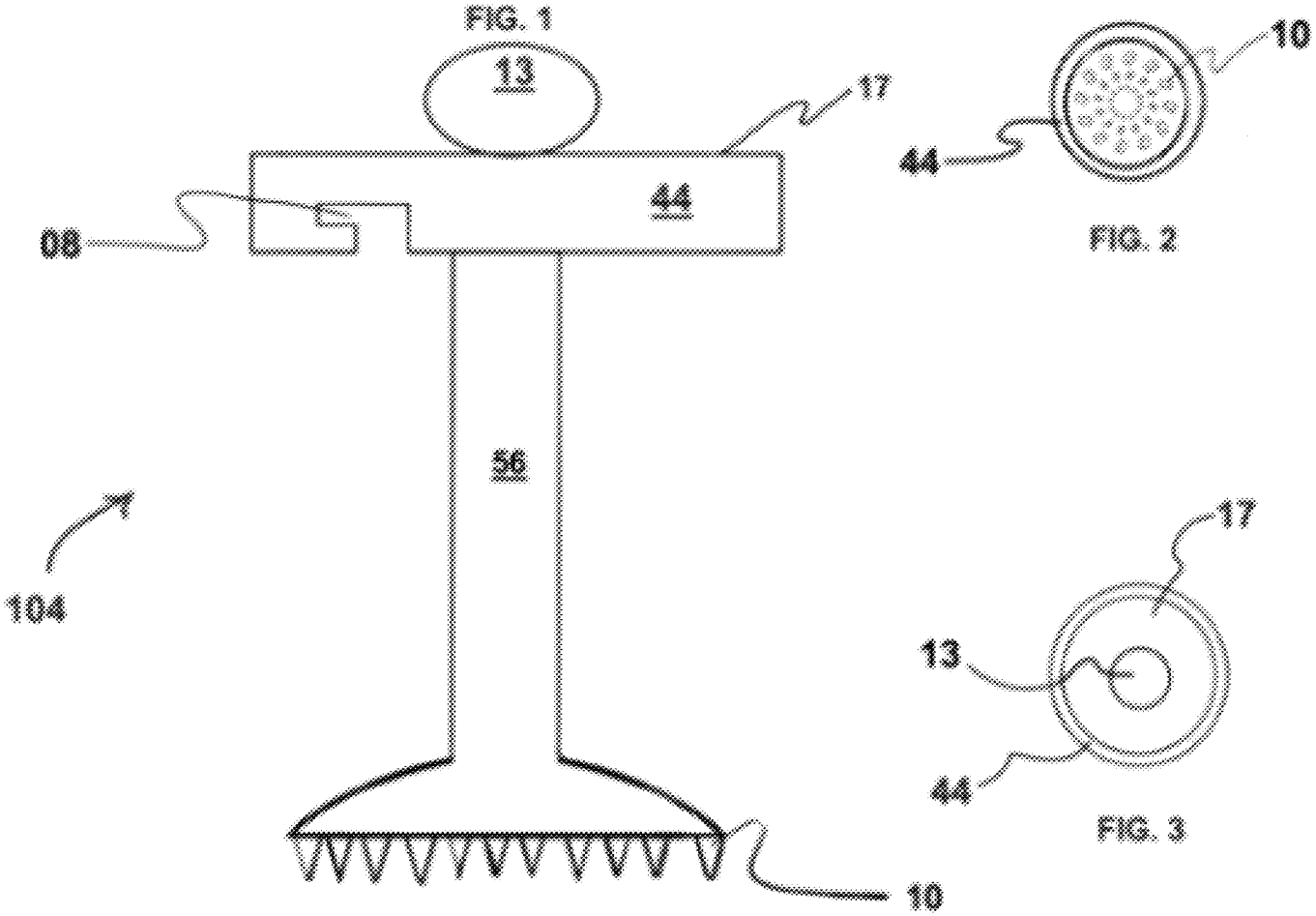
FIG. 1 illustrates a side perspective view of an exemplary embodiment of the kitchen sink debris corralling and transfer apparatus tool of the present invention.
FIG. 2 illustrates a bottom view of an exemplary embodiment of the kitchen sink debris corralling and transfer apparatus tool of the present invention.
FIG. 3 illustrates a top view of an exemplary embodiment of the kitchen sink debris corralling and transfer apparatus tool of the present invention.

Embodiments described and claimed herein address the foregoing problem by providing a kitchen sink debris corralling and transfer tool. The sink debris corralling and transfer tool may be made of a flexible, semi-flexible or solid material or combination of different materials to achieve the same fit and/or function such as TPU, silicone, stainless steel, various metals or a combination of all materials.

To understand how the tool is to be used in conjunction with a kitchen sink corralling and transfer apparatus, it is helpful to define a few of the said apparatus terms. The term "in-sink" is used to denote the three-dimensional sink environment above the top of the sink flange horizontal plane where dishes are laid therein to be washed and is the location of the proposed invention apparatus tool and the kitchen sink corralling and transfer apparatus when installed in its useful position. The term "feed orifice" is used to denote the apparatus orifice that resides in the in-sink space and is where the kitchen sink debris is fed into said apparatus. The term "sink flange orifice" is used to denote the apparatus orifice that resides below the top of the sink flange horizontal plane and is located in the sink flange environment in its useful position and may create a connection with the sink flange vertical wall. The term apparatus "finger lift" is used to denote the apparatus feature that enables proper handling of the apparatus by wrapping a finger around and under the finger lift. The preferred arrangement is having two finger lifts on opposite sides of the apparatus and pulling or pushing on said finger lift(s) to manipulate the apparatus. The apparatus has an inverted conical frustum shape with a singular inward angle as measured from the apparatus inner wall in-sink orifice. A diagram of the apparatus parts will be shown and discussed more in depth forthcoming.

The walls of the tool are solid and may be made of uniform thickness through the full body cavity and its embodiments. The interior of the extension element may be open and unobstructed for the middle portion of the tool especially if made of a stainless steel or the like for cost efficiencies. The tool may have permanent hand hold attached to the top portion of the tool and, additionally, a permanent smaller disk that is attached to the distal working portion of the extension component and has on the bottom distal working side of said disk many permanent distally elevated solid, hardened non-flexible points of contact for grabbing wet refuse that had a tendency to slide around as it did on the previous version of the tool parent application. Another improvement of the tool from its parent application is that there is a minimum of one slot that will house the finger lift of a kitchen sink corralling and transfer apparatus.

This improvement not only ensures the tool is not knocked off during active garbage disposal turning of debris that could forcefully knock off the tool from the apparatus but also remarkably reduce the noise associated with active grinding of said debris as this union also creates a sealing function. Also, this locking union assists in removal and inserting of both the tool and apparatus.

An alternative embodiment of the present invention has a removable hand hold and a removable disk. For example, the top portion of the tool's extension component, where the hand hold component is located and distal portion of said extension component where the disk component is located, may have a union comprising: a permanent female glue-in, threaded or rivet screw-in insert is attached to the interior of the extension component to accommodate a variety of screw-in handle types to accommodate different hand sizes and a similar permanent female screw-in insert be installed in the distal end of the extension component. This distal end permanent female glue-in, threaded or screw-in insert would accept a screw-in type of disks that have various shapes and designs on the working bottom side of the disk to perform the same function of grabbing hold of the debris solidly while pushing with downward force on the tool. The tool's geometric shapes are circular and cylindrical in the preferred embodiment but may be comprised of other geometric shapes while staying within the scope of fit and/or function.

Referring to FIG. 1, illustrates a side perspective view of an exemplary embodiment of the sink debris collection and transfer apparatus tool 104. Tool 104 comprises circular flat surface embodiment 17 that in vertical arrangement is the circular portion of the tool 104 that when in use will reside on the top perimeter of an apparatus feed orifice of a kitchen sink corralling and transfer apparatus. Creating a sealing relationship ensuring debris does not exit the apparatus when the garbage disposal is in use. Circular flat surface 17 may have varying thickness to perform the duties in rigidness. Tool 104 benefits from side edge 44 that surrounds the perimeter of a kitchen sink corralling and transfer apparatus when viewed from a horizontal perspective and is appreciated in FIG. 4. Side edge embodiment 44 allows for the encasement of an apparatus and prevents tool 104 from being knocked off when placed in its useful position. Side edge 44 may fit over and/or within an apparatus top horizontal plane for the part or full vertical plane side edge 44 component of tool 104. Also, the tool has a portion of side edge embodiment 44 that has slot 08 component comprising a notched cut out area that may be semi-rectangular in overall shape and has a proximal, top, portion that is at least twice the horizontal length of an apparatus finger lift. At the larger open end of the rectangular section of slot 08 component, the bottom, distal, portion of side edge 44 component is cut away allowing access for the finger lift(s) of an apparatus to slide up and, when tool 104 is turned, into side edge 44 component and into a narrower section of slot 08 component. Thus, functions to allow slot 08 to accommodate the finger lift(s) of said apparatus to create a sealing relationship when tool 104. If tool 104 is made of a rigid material, a flexible force absorbing circular component may be utilized to absorb the compression force created from the sealing nature of tool 104 and apparatus. In the figure, hand hold 13 is observed and may be attached where both circular flat surface embodiment 17 and proximal or top extension 56 component form a union.

FIG. 2 illustrates a bottom view of an exemplary embodiment of sink debris collection and transfer tool 104. In this view, the side edge embodiment 44 is observed as well as the most distal portion of tool 104, disk 10 embodiment. The distal portion of extension 56 embodiment may have a permanent disk-shaped element that allows multiple hard elevated pyramidal designed attachments which bases would attach to the underside of disk 10 and provide elevated points of contact for the gripping of debris. Attachments may be in the form of a variety of varying geometric shape and/or design elemental distal disk surface components to perform the task of gripping sink debris and pushing against such surface of said component. Disk 10 component may be either permanently attached to the distal portion of extension 56 or of a removable variety.

FIG. 3 illustrates a top view of an exemplary embodiment of sink debris collection and transfer tool 104. This perspective shows circular flat surface embodiment 17 and hand hold 13. The said surface 17 embodiment will be the portion of tool 104 that creates the sealing nature to a kitchen sink corralling and transfer apparatus. Also, this embodiment attaches to hand hold 13 component. In the alternative removable variation of tool 104 hand hold 13, may be removable to accommodate different size hands and hand hold types.

Figure 4:
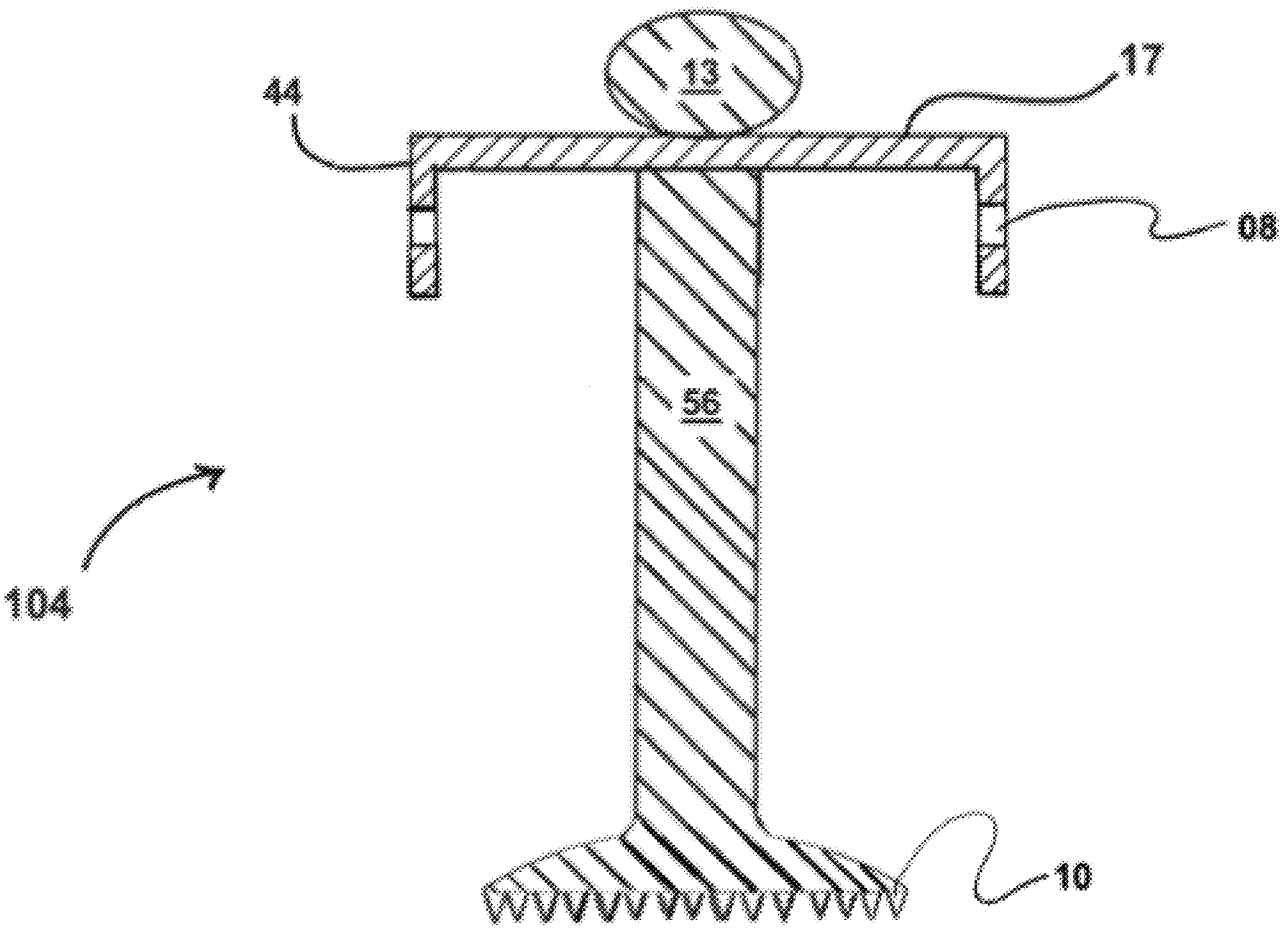
FIG. 4 illustrates a side section view of an exemplary embodiment the kitchen sink debris corralling and transfer apparatus tool of the present invention.

FIG. 4 illustrates a cross section view of an exemplary embodiment of the sink debris collection and transfer tool 104. It is in this view that one can appreciate the fusing of circular flat surface embodiment 17 and side edge embodiment 44. Side edge embodiment 44 may be the thickness of circular flat surface embodiment 17 ideally to create a sealing relationship to be satisfied. Improvement to tool 104 meets the need for a locking ability to a kitchen sink corralling and transfer apparatus. This need is solved by having a section of side edge 44 component manipulated to accept the hand hold(s) of the kitchen sink corralling and transfer apparatus. This manipulation takes place in the general form of a semi rectangular element that has half of the full proximal horizontal length of said element cut out to accept said hand hold. The other half of the cutout rectangle is cut out just wide enough, vertically, to slot the hand hold with enough pressure to ensure a snug fitting. Slotted area 08 is seen inside edge component 44.

Yet another improvement is the need for a surface area that houses elevated surfaces that collectively form a gripping surface as to grip wet or unwieldy debris to be gripped and not allow said debris to slide around during manual pushing of said debris. Disk 10 component is shown as having semicircular proximal top planar and flat distal planar portions with integrated distally elevated, hardened points where all sides of each of the elevated surface meet to form individual points, distally. These points may have rectangular bases that take the form of an upside-down pyramid and are attached to the distal side of disk 10 component. The disk could be made of hardened dishwasher safe plastic, hardened silicone, TPU, metal or stainless steel. Lastly, hand hold 13 and cross section of extension 56 embodiment is shown.

Figure 5:
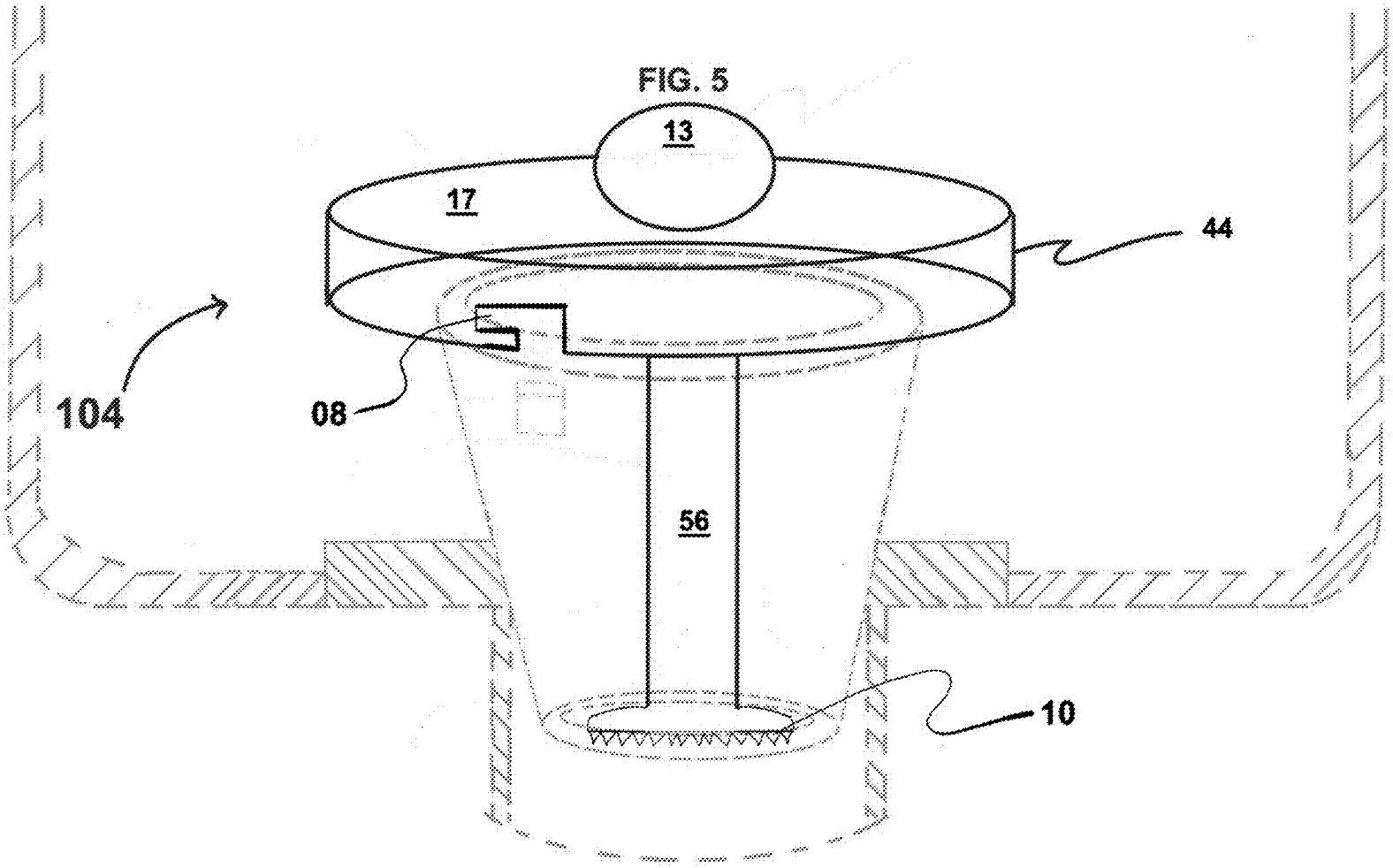
FIG. 5 illustrates the sink debris corralling and transfer apparatus tool and a kitchen sink corralling and transfer apparatus in a kitchen sink environment of the present invention.

FIG. 5 illustrates sink debris collection and transfer tool 104 in an environment that also houses a kitchen sink corralling and transfer apparatus. The environment is drawn of lighter color hashed lines and kitchen sink debris collection and transfer tool 104 is of dark solid line. It is observed that tool 104 is shown in a useful position upon and inside an apparatus, which is installed in a sink. The apparatus finger lift is visible and is indicated as a component of the apparatus. The locking ability of slot 08 component to an apparatus finger lift 14 occurs by, during rotation of tool 104 where the apparatus finger lift(s) 14 and the rectangular slot 08 align, a small portion of the rectangular slot area bottom section located on side wall 44 component of tool 104 is vertically smaller; the finger lift naturally accepts the finger lift into the rectangular open space of the slot 08 component. Upon rotating tool 104, the area of slot 08 component that is vertically smaller snags the apparatus finger lift and squeezes flat circular surface 17 embodiment to the top portion of the apparatus in sink orifice wall together. The slot 08 component may be horizontal or angled. This finger lift fits inside slot 08 component inside wall 44 of top 104. Also shown is disk 10 component that houses the bases of the permanent distally elevated solid, hardened non-flexible points of contact for grabbing wet refuse that tend to slide around. These points of contact are spaced in a manner that will not hold debris between them or when manually pushing said disk against the debris. These points of contact element bases may take on a pyramidal design but the effectiveness of these points of contact is the non-flexing, hardened, elevated surface, repeating pattern, and pointedness. Disk 10 proximal shape portion of the component may be arcuate as shown or may be proximally flat along a horizontal plane on both the proximal and distal portions of the disk. Disk 10 is comprised of many permanent distally elevated solid, hardened non-flexible points of contact for grabbing wet refuse that tends to slide around. Disk 10 is smaller in circumference than the internal flaps of the kitchen sink corralling and transfer apparatus smallest opening, which, may be the distance between a flap that covers the weep hole of one side of said apparatus to the opposite internal side of the flap of said apparatus.

Figure 6:
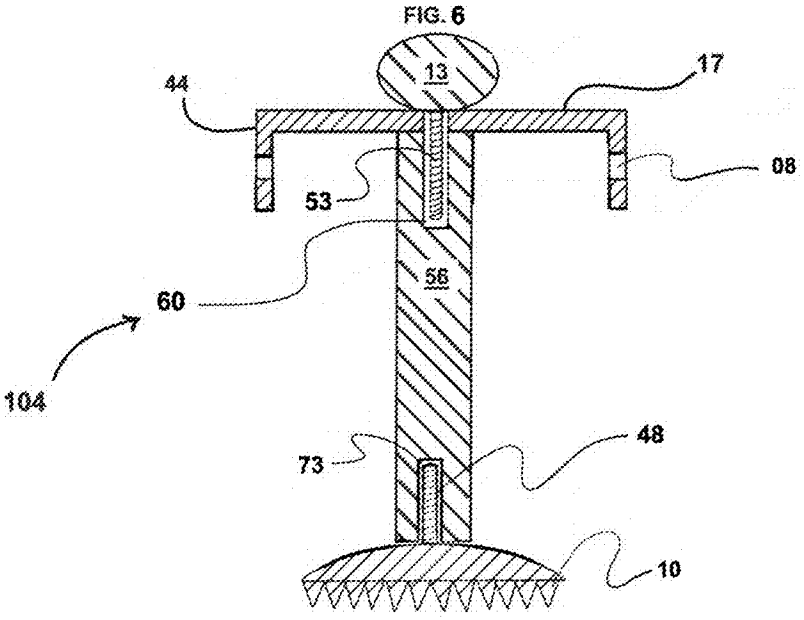
FIG. 6 illustrates a cross section with a variation of the sink debris corralling and transfer apparatus tool with mechanical attachments that enables the hand hold and disk components to be removable.

FIG. 6 illustrates a cross section with a variation of the sink debris corralling and transfer apparatus tool with mechanical attachments that enables the hand hold and disk components to be removable. Hand hold 13 may comprise a circular design or other ergonomic designs and may be removable from tool 104 by way of permanently integrated screw 53 component, that is permanently fixed during manufacturing, and be rotated in or out of screw housing 60 component that is permanently attached to the most proximal portion of extension 56 embodiment when in its useful vertical position as an alternative removable connection. Tool 104 is equipped with extension 56 that is comprised of a predominantly circular geometric design and may be attached to the underside of circular flat surface embodiment 44 and extends distally, when installed in a useful position, toward the sink drain hole. Extension 56 may be disposed in a vertically centered or off centered arrangement in relation to the center of tool 104 in its useful position. The build purpose of extension 56 is to withstand vertical pushing forces and to aid in supporting and accepting circular disk 10 component that may have on the bottom working surface of said disk, for example, distally raised or elevated patterned pyramidal points or wave type design patterns. This alternative to the permanent attachment of extension 56 component to circular disk 10 component is to have the ability to replace said disk with alternative disks in case of breakage or allow for various patterned disks to achieve the grasping potential of various debris. This connection task may be accomplished, for example, by having a union with permanent insert female screw housing 73 component attached to the interior of the terminal end of extension 56 component on its distal end and male screw 48 component permanently attached to the disk, for example. There may be more than one connection type to joining of both hand hold 13 component and circular disk 10 components to the proximal and distal ends of the extension 56 component. Mentioned above is an example of a method of attachment. Other mechanical, magnetic, or electrical forms of attachments may be utilized to achieve the same fit and/or utilitarian function.

To understand how tool 104 is used with a kitchen sink corralling and transfer apparatus, the following is a description of said apparatus components. The apparatus when placed in the "in-sink" space in its useful position in the sink, in-sink orifice of said apparatus having the larger diameter resides in the mentioned "in-sink space" whereas the sink flange orifice is located below the sink floor or the horizontal plane of the sink floor and is in the sink flange. But note the apparatus and tool 104 only extends distally no further than in the sink collar.

Tool 104 does not reside distally below the sink collar nor in the commuting chamber of the garbage disposal if such as collar is not present. The tool will also work in a manner where a kitchen sink corralling transfer apparatus is physically attached to or work where said apparatus is part of a kitchen sink during manufacturing. Thus, tool 104 offers the same utilitarian function even when a garbage disposal is not present. The apparatus when placed in the "in-sink" space in its useful position in the sink, the in-sink orifice of said apparatus having the larger diameter resides in the mentioned "in-sink space" whereas the sink flange orifice is located below the sink floor or the horizontal plane of the sink floor and is in the sink flange. The apparatus further comprises tear drop weep hole(s), which, as the name suggests, is shaped like a water/tear drop. The tear drop weep hole enables seeds including both larger type of seeds such as, but not limited to watermelon seeds or the like and smaller solids and liquids to pass through the apparatus and into the sink drain hole. The tear drop weep hole is located near the bottom of the apparatus and more specifically in proximity to the sink flange orifice. More specifically, the wider part of the tear drop weep hole is located above the top of the sink flange and sink floor union horizontal plane and the tapered portion of the tear drop weep hole intersects the said plane and terminates below the top of the sink floor and sink flange union horizontal plane. In some embodiments of the kitchen sink corralling and transfer apparatus, a flap is provided above each tear drop weep hole. When the apparatus is in a useful position, vertically, the flap is attached to the inner wall above each tear drop weep hole and covers minimally the width of the weep hole in a horizontal plane and minimally the height of the weep hole in a vertical plane.

The method of use is to, in the alternative design, as denoted by having removable hand hold 13, screw component 53, and/or the removable disk 10, screw component 48, said hand hold screw component 53 to be rotated clockwise into place on the top of tool 104, into screw housing 60 into the top portion of extension 56.

Then, insert into place screw component 48 in a counterclockwise direction disk 10 into the distal end of extension 56, screw housing 71 component, physically place tool 104 upon and into sink debris corralling and transfer 16 apparatus ensuring the underside of circular flat surface embodiment 17 is in direct contact with the top perimeter feed orifice portion of the apparatus. Turning hand hold 13 of tool 104 also turns tool 104, thus accepting and seating finger lift(s) 14 of the kitchen sink corralling and transfer apparatus into tool slot(s) 08 of the tool 104. Finger lift(s) 14 slides into position thus creating both a sealing position and locking of both tool 104 and apparatus together.

The above description and examples provide a description of the structure and use of exemplary embodiments of the described articles of manufacture and methods. A person of ordinary skill in the art would understand that various changes or modifications may be made thereto without departing from the scope of the invention.

What is claimed is:

1. A debris corralling tool for use in a sink, comprising:
a removable hand hold component;
a circular flat component having a side edge having a vertical face,
wherein the circular flat component is attached to and below the handhold component,
wherein the vertical face has a slot formed therein; and
an extension component, said extension component having a vertical portion attached to and extending downward from the circular flat component and terminating at an attached disk component,
wherein the circular flat component is of a sufficient diameter to be greater than a sink drain hole diameter;
wherein the disk component has a bottom surface, the bottom surface having a plurality of contact points configured to trap debris between individual contact points in the plurality.

2. The debris corralling tool of claim 1, wherein the extension component is removable from the circular flat component.

3. The debris corralling tool of claim 2, wherein the extension component includes a threaded bore and is attached to the removable hand hold component by a threaded member retained by the removable handheld component and inserted into the threaded bore.

4. The debris corralling tool of claim 1, wherein the extension component is permanently attached to the circular flat component.

5. The debris corralling tool of claim 1, wherein contact points in the plurality of contact points are pyramid-shaped.

6. The debris corralling tool of claim 1, wherein the slot comprises a notch formed in the vertical face.

7. The debris corralling tool of claim 6, wherein the notch is sufficiently dimensioned to accept a human fingertip, wherein the notch serves as a lifting point for removing the tool from placement over the sink drain hole.

8. The debris corralling tool of claim 1, wherein the disk component is removably-attached from the extension component by a threaded member protruding upward from the disk component and received by a secondary threaded bore formed in the bottom of extension component and is one of a plurality of disk components similarly dimensioned as the disk component, and wherein the disk components in the plurality have bottom surfaces having pluralities of contact points formed on the bottom surfaces, the plurality of contact points being non-pyramid shaped, wherein disk components in the plurality are interchangeable and configured to attach to the bottom of the extension component.

9. The debris corralling tool of claim 1, wherein the circular flat component is placed on top of a secondary sink debris corralling and transfer apparatus, thereby forming a seal between the circular flat component and the secondary sink debris corralling and transfer apparatus.

10. The debris corralling tool of claim 1, wherein the disk component includes elevated surfaces in the form of a semicircular proximal top planar portion and a flat distal planar portion, wherein the proximal top planar portion and a flat distal planar portion both include distally elevated hardened points where all sides of the proximal top planar portion and a flat distal planar portion meet and form individual points.

11. The debris corralling tool of claim 1, wherein the individual points include rectangular bases and are shaped to resemble upside down pyramids and are attached to a distal side of disk component.

12. The debris corralling tool of claim 11, wherein the disk component is made of a selection from the group consisting of plastic, hardened silicone, thermoplastic polyurethane, metal, and stainless steel.

* * * * *